US007878134B2

(12) United States Patent
Puppi et al.

(10) Patent No.: US 7,878,134 B2
(45) Date of Patent: Feb. 1, 2011

(54) METHOD FOR CONTROLLING THE DEFORMATION OF A SURFACE OF A SAIL OF A SAILING BOAT DURING A DIRECTION CHANGE MANEUVER

(75) Inventors: Cristiano Puppi, Milan (IT); Pier Giuseppe Piantanida, Milan (IT); Renato Caretta, Milan (IT); Thomas Mattia Mauro Ponta, Milan (IT)

(73) Assignee: Pirelli & C. S.p.A., Milan (IT)

( * ) Notice: Subject to any disclaimer, the term of this patent is extended or adjusted under 35 U.S.C. 154(b) by 165 days.

(21) Appl. No.: 12/085,581

(22) PCT Filed: Dec. 13, 2005

(86) PCT No.: PCT/IT2005/000731

§ 371 (c)(1),
(2), (4) Date: May 28, 2008

(87) PCT Pub. No.: WO2007/069280

PCT Pub. Date: Jun. 21, 2007

(65) Prior Publication Data

US 2009/0165691 A1 Jul. 2, 2009

(51) Int. Cl.
*B63H 9/04* (2006.01)

(52) U.S. Cl. ..... 114/102.25

(58) Field of Classification Search ..... 114/102.1, 114/102.12–102.16, 102.22–102.27
See application file for complete search history.

(56) References Cited

U.S. PATENT DOCUMENTS 4,503,796 A 3/1985 Bierig
5,333,569 A * 8/1994 Henderson ..... 114/102.27

FOREIGN PATENT DOCUMENTS

| | | |
|---|---|---|
| DE | 196 14 151 A1 | 10/1996 |
| FR | 2 773 773 | 7/1999 |
| GB | 2 216 086 A | 10/1989 |
| GB | 2 354 218 A | 3/2001 |
| GB | 2 370 025 A | 6/2002 |
| WO | WO 94/14648 | 7/1994 |

* cited by examiner

*Primary Examiner*—Daniel V Venne
(74) *Attorney, Agent, or Firm*—Finnegan, Henderson, Farabow, Garrett & Dunner, L.L.P.

(57) ABSTRACT

A method for controlling the deformation of a surface of a sail of a sailing boat during a direction change maneuver, includes arranging at least one inflatable batten into a respective seat formed on a side surface of the sail, the at least one batten being inflated at a predetermined working pressure as to impart to said at least one inflatable batten a bending stiffness having, with no bending load, a predetermined value, carrying out a maneuver for changing the direction of the sailing boat, wherein in a first part of maneuver, the at least one batten is subjected to the action of an increasing bending load, and in a second part of the maneuver, the bending load ends its action on the at least one batten, during the maneuver the mechanical properties of the at least one batten being changed so that as the bending load increases in the first part of the maneuver, the value of the bending stiffness of the at least one batten decreases considerably, and as the action of the bending load ends in the second part of the maneuver, the bending stiffness of the at least one batten returns to the predetermined value.

19 Claims, 11 Drawing Sheets

METHOD FOR CONTROLLING THE DEFORMATION OF A SURFACE OF A SAIL OF A SAILING BOAT DURING A DIRECTION CHANGE MANEUVER

CROSS REFERENCE TO RELATED APPLICATION

This application is a national phase application based on PCT/IT2005/000731 filed Dec. 13, 2005, the content of which is incorporated herein by reference.

BACKGROUND OF THE INVENTION

1. Field of the Invention

The present invention relates to a method for controlling the deformation of a surface of a sail of a sailing boat during a direction change maneuver, specifically a veer or a jibe.

The invention also relates to a sail for a sailing boat and to a batten for such sail, such sail and such batten allowing the above method to be carried out.

2. Description of the Related Art

Preferably, but not exclusively, the method is carried out by a crew of a racing sailing boat, such as an America's Cup class boat. The sails and the battens of the present invention are thus intended to be preferably but not exclusively used on such type of boats.

Throughout the following description and appended claims, the word: veer, is used to indicate a direction change maneuver with substantially fore wind, adapted to bring the boat to get wind on the side opposite that where it gets wind before the maneuver is carried out, while the word: jibe, is used to indicate a direction change maneuver with substantially aft wind, adapted to bring the boat to get wind on the side opposite that where it gets wind before the maneuver is carried out.

As known, in sailing boats, especially in racing sailing boats, the use of sails provided with suitable stiffening battens is diffused; this is to improve the boat performance and speed during the race.

The sails provided with battens are, for example, the mainsail, the genoa and the jib.

The battens are housed into respective seats or pockets formed on the side surfaces of the sails and have the function of imparting desired bending stiffness and/or aerodynamic properties to the sails, when unfurled, while offering at the same time the largest sail surface to the wind. Typically the battens, in the top portion of the sails, allow forming the roach that allows to increase the surface of the sail exposed to the wind and thus to improve the boat performance and speed.

Specifically, in the genoa, the battens have the function of imparting a desired bending stiffness to the sails and of preventing the flapping of the after leech; in that case, therefore, the battens follow the sail profile imposed by the wind, offering to the wind a sail surface as largest as possible. Typically, four or five battens are used in the genoa, of which at least three are arranged in the top portion of the sail, where the after leech has a strong roach, and one or two battens in the bottom portion of the sail, where the after leech is straighter.

In the mainsail, on the other hand, the battens have the function of enhancing the sail aerodynamic properties imparting the desired shape thereto.

Generally, the battens used in the sails of racing sailing boats are made of composite materials, such as resins reinforced with glass or carbon fibres.

GB 2354218 discloses a stiffening batten for a sail, comprising an inflatable pipe provided with means for attaching to the sail edge. The inflatable pipe is made, for wide sails, of reinforced elastomeric material and for small sails, of polymeric material, preferably PVC or polyethylene.

WO 94/14648 discloses an inflatable sail batten, in particular for a mainsail intended to be wound inside the boat mast. The batten is arranged in a special pocket formed on the sail. The batten consists of a fluid-impervious flexible tube having sealed opposite ends. At one of these ends, a small tube communicating with the interior of the flexible tube is connected to a supply tube extending along the sail edge. The supply tube is connected to a valve for inflating the batten. The fluid-impervious flexible tube of the batten consists of an inner layer of nylon or polyester coated with an outer layer of polyurethane; optionally, the tube may be made of polyurethane or rubber coated with a woven fabric.

SUMMARY OF THE INVENTION

The Applicant has studied how to control the deformation of the sail surface during the veer and jibe maneuvers of sailing boats, in particular of racing sailing boats, to minimize the boat speed loss while the above maneuvers are carried out. Specifically, the Applicant has evaluated the mechanical behavior of the battens during the above maneuvers, aware of the critical role of such battens while such maneuvers are carried out.

The Applicant has noted, with special reference to the genoa, that during the veer and jibe maneuvers the sail is maneuvered to allow its after leech to pass from one side to the other of the sailing boat mast. During such passage, the battens hit the equipment of the boat mast, thus being subjected to the action of a bending load which is always increasing until the battens become deformed and are able to go beyond the mast.

The Applicant has thus determined, as a critical element of the battens for sailing boat sails, the fact that on the one side, they must offer the desired features of bending stiffness to the sail, adapted to allow the sail to get the wind thrust and on the other side, they must be sufficiently flexible so as to not oppose high resistance to the sail passage beyond the sailing boat mast during the above direction change maneuvers, to then return, at the end of the maneuver, to offer the desired bending stiffness features to the sail. Such battens, moreover, must be able to stand high fatigue stresses they are subjected to due to the frequency of such maneuvers during the races.

In this perspective, the Applicant has verified that the battens of the prior art, while bending when subjected to a bending load due to the effect of the thrust against the mast equipment during the veer and jibe maneuvers, still exhibit a high resistance to the passage of the batten beyond the mast. This is due to the fact that they exhibit such mechanical properties that their bending stiffness remains always high as the bending load increases while the maneuver is carried out. Moreover, the battens of composite material typically used on racing sailing boats, as the bending load increases, are subjected to rupture by violent impact, excessive deformation or fatigue after a certain period of use.

The Applicant has found that it is possible to control the surface deformation of the sail of a sailing boat, during a direction change maneuver, by using an inflatable batten having such mechanical properties that up to a predetermined value of the bending load determined by the wind thrust on the sail, the bending stiffness remains substantially constant, whereas as the bending load increases due to the thrust against the mast equipment during the first part of the direction change maneuver, the bending stiffness of the batten decreases considerably, to then immediately return to the initial value, once the batten has gone beyond the mast.

The present invention thus relates, in a first aspect thereof, to a method for controlling the deformation of a surface for a sail of sailing boat during a direction change maneuver, said method comprising the steps of:

arranging at least one inflatable batten into a respective seat obtained on a side surface of a sail of a sailing boat, said at least one inflatable batten being inflated at such a pressure as to impart to said at least one inflatable batten a bending stiffness having, with no bending load, a predetermined value;

carrying out a direction change maneuver of the sailing boat, wherein in a first part of said maneuver said at least one batten is subjected to the action of an increasing bending load and in a second part of said maneuver said bending load ends its action on said at least one batten, during said maneuver the mechanical properties of said at least one batten being modified so that as said bending load increases in said first part of the maneuver, the value of the bending stiffness of said at least one batten decreases considerably and as said bending load ends its action in said second part of the maneuver, the bending stiffness of said at least one batten returns to said predetermined value.

Advantageously, the use of a batten having mechanical properties which, while the direction change maneuver is carried out, change as described above, allows optimum control of the sail surface deformation during such maneuver. Such batten, in fact, exhibits the advantageous feature of having a high initial bending stiffness up to a predetermined load value. Said bending stiffness is obtained by the inflation pressure, the diameter and the elastic modulus of the materials making up the batten, so as to allow the sail to get the wind thrust in the best possible way and to improve its behavior as the wind intensity changes, offering to the wind a sail surface as largest as possible. In any case, the high initial stiffness does not hinder the execution of the direction change maneuver; in fact, as the bending load on the batten increases, by the effect of the thrust against the mast equipment, the value of the batten stiffness decreases up to reach very low values, and optionally become substantially null when the bending load reaches a predetermined value, to then return immediately to the initial value when the batten stretches once it has gone beyond the mast.

In this way, the Applicant has obtained an excellent compromise between bending stiffness and flexibility. In particular, the substantial reduction of the bending stiffness as the bending load increases in the first part of the maneuver and the sudden return to the initial stiffness value in the second part of the maneuver allow carrying out the maneuver in a time shorter than what it is possible to do with the prior art battens, thus enabling the boat to minimize the speed loss consequent to the maneuver itself.

In this way, the Applicant has obtained an excellent compromise between bending stiffness and flexibility. In particular, the substantial reduction of the bending stiffness as the bending load increases in the first part of the maneuver and the sudden return to the initial stiffness value in the second part of the maneuver allow carrying out the maneuver in a time shorter than what it is possible to do with the prior art battens, thus enabling the boat to minimize the speed loss consequent to the maneuver itself.

In a second aspect thereof, the present invention relates to a sail for sailing boats, comprising:

at least one seat for housing a respective batten;

at least one inflatable batten housed into said at least one seat, said at least one inflatable batten comprising:

a fluid impervious wrapping containing a fluid under pressure so as to impart a bending stiffness to said at least one batten, said bending stiffness having, with no bending load, a predetermined value;

a reinforcing structure associated with said wrapping, preferably external thereto, and comprising a plurality of reinforcing thread-like elements arranged crossed to each other (preferably, as it will better be seen hereinafter, at a predetermined angle comprised between about 65° and about 115°), said at least one batten being such that, when subjected to an increasing bending load, the bending stiffness thereof decreases considerably and when said bending load ends its action, the bending stiffness thereof returns to said predetermined value.

In particular, the Applicant has verified that a sail of the type described above exhibits the desired features of bending stiffness, when unfurled and of flexibility at the battens during the direction change maneuvers.

More in particular, the above crossed arrangement of the reinforcing thread-like elements in the batten reinforcing structure imparts a high bending stiffness to the batten itself with no bending load and a substantial decrease of such stiffness as the bending load increases.

In a third aspect thereof, the present invention relates to a batten for sails of a sailing boat, comprising:

a fluid impervious wrapping adapted to be inflated by a fluid under pressure, wherein such fluid under pressure imparts a bending stiffness to said batten, said bending stiffness having, with no bending load, a predetermined value;

a reinforcing structure associated with said wrapping, preferably external thereto, and comprising a plurality of reinforcing thread-like elements arranged crossed to each other at a predetermined angle;

wherein, when said wrapping is inflated at said working pressure and said batten is subjected to an increasing bending load, the bending stiffness thereof decreases considerably and when said bending load ends its action, the bending stiffness thereof returns to said predetermined value.

The present invention, in at least one of the above aspects thereof, could exhibit the following preferred features.

According to preferred embodiments of the present invention, the value of said bending stiffness decreases to be comprised between about 0.01% and about 50% of said predetermined value.

Even more preferably, the value of said bending stiffness decreases to be comprised between about 0.01% and about 30% of said predetermined value.

Even more preferably, the value of said bending stiffness decreases to be comprised between about 0.01% and about 10% of said predetermined value.

Even more preferably, the value of said bending stiffness decreases to be comprised between about 0.01% and about 5% of said predetermined value.

More preferably, for a bending load higher than a predetermined threshold value, the bending stiffness of said at least one batten is substantially null.

In a preferred embodiment, the above predetermined value of bending stiffness with no bending load is comprised between about 10 $Nm^2$ and about 100 $Nm^2$.

Preferably, said batten is inflated at an operating pressure comprised between about 5 bar and about 50 bar.

The bending stiffness of the batten depends, the batten diameter being equal, on the inflating pressure of the batten itself. By changing the pressure in the above range of values, it is advantageously possible to modulate the batten stiffness so as to obtain a good behavior of the sail both with weak and with strong wind.

More preferably, the working pressure of the batten is comprised between about 15 bar and about 50 bar for battens with an inner diameter comprised between about 20 mm and about 35 mm.

In a different preferred solution, the working pressure of the batten is comprised between about 5 bar and about 30 bar for battens with a diameter comprised between about 35 mm and about 70 mm.

Such ranges of pressure values have been verified to be such as to allow optimum behavior of the sail both with weak and with strong wind.

According to preferred embodiments of the present invention, said batten is provided with a reinforcing structure comprising a plurality of reinforcing thread-like elements arranged crossed to one another.

Preferably, the above reinforcing thread-like elements are arranged crossed at a predetermined angle comprised between about 65° and about 115°.

Preferably, said predetermined angle is comprised between about 70° and about 110°.

More preferably, said predetermined angle is comprised between about 80° and about 100°.

Even more preferably, said predetermined angle is substantially a right angle.

Preferably, said at least one batten comprises a fluid impervious wrapping containing a fluid at a working pressure.

Preferably, a reinforcing structure is associated with said wrapping, preferably outside thereto.

Preferably, said reinforcing structure is closed at the ends of said batten.

Advantageously, the Applicant has verified that a reinforcing structure of the type described above allows achieving the desired features of bending stiffness and flexibility. In particular, the above crossed arrangement of the reinforcing thread-like elements of the batten imparts to the batten itself, for the different objects of the present invention, a high bending stiffness for low load values and a substantial decrease of such stiffness up to a negligible or substantially null value as the bending load increases.

According to preferred embodiments of the present invention, said reinforcing structure comprises a layer comprising first reinforcing thread-like elements arranged along a first direction and second reinforcing thread-like elements arranged along a second direction inclined, relative to said first direction, by said predetermined angle.

According to further embodiments of the present invention, said reinforcing structure comprises two overlapped layers of reinforcing thread-like elements, a first layer comprising first reinforcing thread-like elements arranged along a first direction and a second layer comprising second reinforcing thread-like elements arranged along a second direction inclined, relative to said first direction, by said predetermined angle.

Preferably, said second reinforcing thread-like elements are arranged parallel to one another along a substantially longitudinal direction of said batten.

Preferably, said first reinforcing thread-like elements are arranged parallel to one another along a substantially circumferential direction of said batten.

In an alternative embodiment of the batten of the present invention, said second reinforcing thread-like elements extend along respective paths having an angle of inclination comprised between about +20° and about −20° relative to a longitudinal direction of said batten.

In a further alternative embodiment of the batten of the present invention, said first reinforcing thread-like elements extend along respective paths having an angle of inclination comprised between about +5° and about −5° relative to a circumferential direction of said batten.

Advantageously, for the various objects of the present invention, the reinforcing thread-like elements arranged along the circumferential direction of the batten (or along the above paths inclined relative to said direction) ensure the containment of the inflating pressure, whereas the reinforcing thread-like elements arranged along the longitudinal direction of the batten (or along the above inclined paths) are adapted to contain the pressure acting in the axial direction and for imparting the desired bending stiffness features. The Applicant has verified that, advantageously, such a structure is particularly advantageous as it allows separating circumferential deformations from longitudinal ones.

Preferably, the layer of longitudinal reinforcing thread-like elements is arranged external to the layer of circumferential reinforcing thread-like elements. The Applicant has verified that, advantageously, such arrangement allows maintaining the batten diameter during the inflation.

Preferably, said reinforcing thread-like elements preferably comprise cords made of kevlar or other material having a high modulus.

Such reinforcing thread-like elements are preferably incorporated in a vulcanized elastomeric material, for example based on diene elastomers charged with at least one reinforcing charge, for example carbon black.

According to preferred embodiments of the present invention, said at least one batten comprises, at a first end thereof, a first closing cap.

Preferably, said at least one batten comprises, at a second end thereof, a second cap comprising an inflating/deflating valve.

Preferably, said first and second closing caps comprise a tubular sleeve sealingly coupled to an inner surface of said fluid impervious wrapping.

Preferably, the reinforcing thread-like elements are connected to the above first and second closing caps.

Even more preferably, the above reinforcing thread-like elements are longitudinal reinforcing thread-like elements.

Preferably, said tubular sleeve is provided with a first sealing lip in abutment against a front end surface of said fluid impervious wrapping and a tubular collar sealingly coupled to an outer surface of said reinforcing structure and to said sleeve. Such configuration advantageously ensures that the desired working pressure is maintained.

Preferably, said inflating/deflating valve is associated with a front surface of said sleeve, said sleeve further comprising a protection lip for said inflating/deflating valve. Such protection lip is advantageously provided for preventing the accidental opening of the valve during the introduction/removal of the batten into/from the sail seat and while the maneuvers are carried out, when the batten hits against the mast equipment.

More preferably, said protection lip comprises a tapered side surface so as to reduce weight and overall dimensions.

According to preferred embodiments of the present invention, said batten has a substantially tubular shape with circular section substantially constant along the entire longitudinal extension thereof.

In a further alternative embodiment, said batten has a substantially cylindrical shape wherein at least one end is tapered as a cone. In this way it is possible to have a variable stiffness along the batten axis, thus allowing better shaping of the sail shape.

Preferably, said sail is a genoa or a mainsail.

BRIEF DESCRIPTION OF THE DRAWINGS

Further features and advantages of the present invention will appear more clearly from the following detailed description of a preferred embodiment, made with reference to the attached drawings. In such drawings.

DETAILED DESCRIPTION OF THE INVENTION

Figure 1:
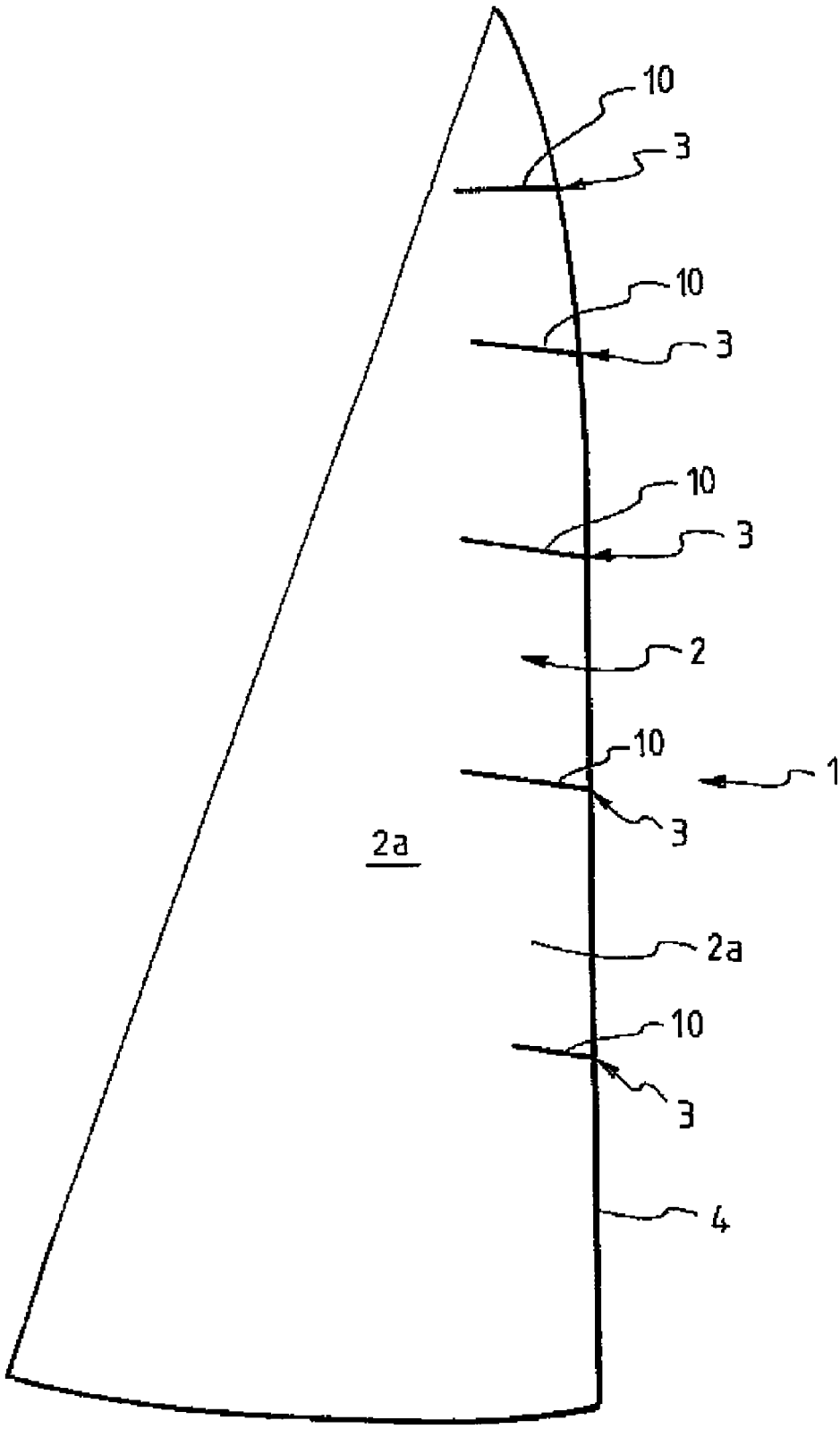
FIG. 1 is a schematic side view of a sail according to the present invention.

In FIGS. 1 and 4*a*-4*d*, reference numeral 1 indicates a sail according to the present invention. The sail 1, in particular, is a genoa for a racing sailing boat, such as an America's Cup class boat.

Sail 1 comprises a composite fabric 2 of conventional shape and material. On a side surface 2*a* of the composite fabric 2 a plurality of seats or pockets is provided, all indicated by reference numeral 3, which house respective stiffening battens, all indicated by reference numeral 10.

In the example shown in FIGS. 1 and 4*a*-4*d*, there are shown five battens 10 of different length arranged one on top of the other along the portion of sail 1 at after leech 4. In particular, three battens 10 are arranged in the top portion of after leech 4, where the sail roach is larger and two battens 10 are arranged in the bottom portion of sail 1, where the after leech 4 is straighter. Number, length and position of battens 10 may be different from what shown.

Figure 2:
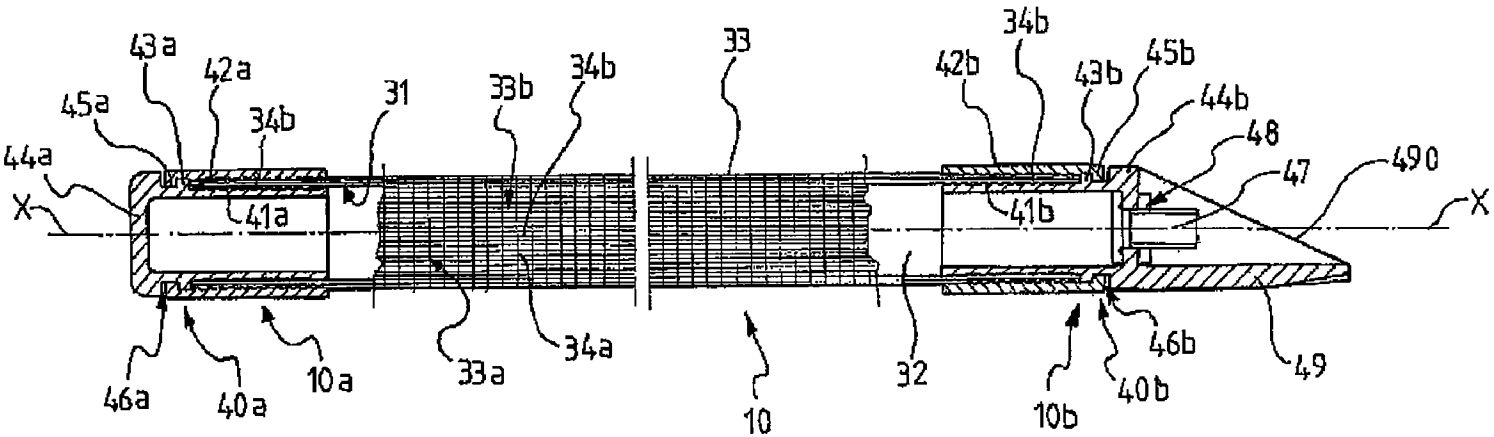
FIG. 2 is a schematic, partly sectioned and cutaway view of a batten according to the present invention used in the sail of FIG. 1.
Figure 3:
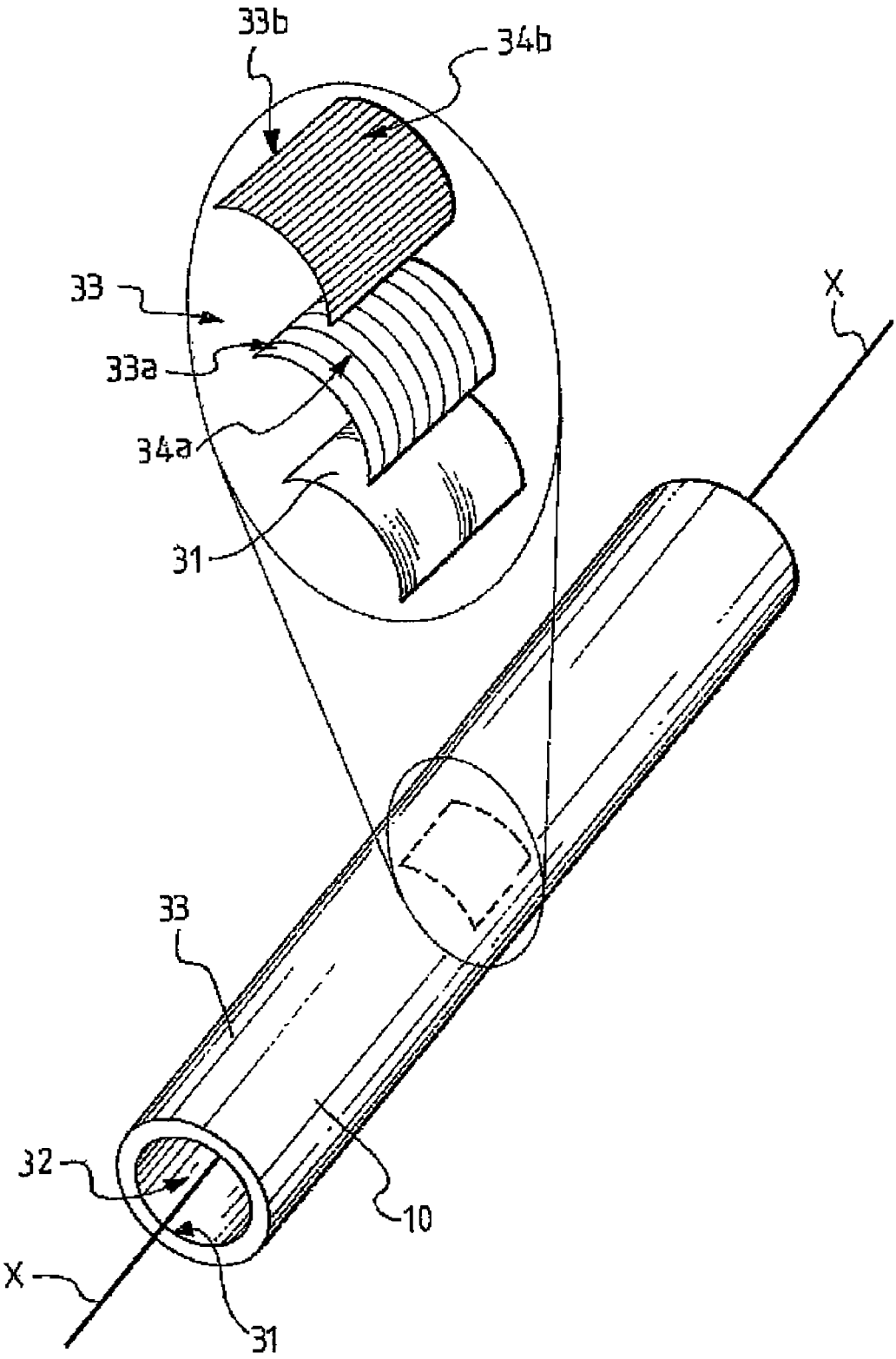
FIG. 3 is a schematic perspective view of a central portion of the batten of FIG. 2, with an enlarged detail of a portion of the side wall thereof according to a preferred embodiment of the present invention.

As shown in FIGS. 2 and 3, each batten 10 comprises a fluid impervious wrapping 31 having substantially tubular shape and defining a chamber 32 therein that contains a fluid under pressure.

Wrapping 31 is associated, preferably at the outer surface thereof, with a reinforcing structure 33, preferably by co-vulcanization.

The fluid impervious wrapping 31 and the reinforcing structure 33 extend along a longitudinal axis X-X of batten 10 and preferably, have a circular cross section of constant diameter along such axis X-X.

As schematically shown in the enlargement of FIG. 3, the reinforcing structure 33 comprises a plurality of reinforcing thread-like elements 34*a*, 34*b* arranged, as already mentioned, according to a crossed layout with an angle comprised between about 65° and about 115°. In the preferred embodiments of the batten of the present invention, the above crossed angle is comprised between about 70° and about 110°, more preferably between about 80° and about 100°.

In a particularly preferred embodiment of the batten of the present invention, shown in FIGS. 2 and 3, the above crossed angle is substantially a right angle.

As better shown in FIG. 3, the reinforcing structure 33 comprises two overlapped layers of reinforcing thread-like elements, such layers being respectively indicated by reference numerals 33*a* and 33*b*. Layer 33*a* comprises a plurality of reinforcing thread-like elements 34*a* arranged parallel to one another and extending along a circumferential direction of batten 10, whereas layer 33*b* comprises a plurality of reinforcing thread-like elements 34*b* arranged parallel to one another and extending along a longitudinal direction of batten 10. Layer 33*b* is arranged outside layer 33*a* and is associated with layer 33*a* preferably by co-vulcanization.

As already mentioned, in a first alternative embodiment (not shown), the reinforcing thread-like elements 34*a*, rather than extending along a circumferential direction substantially perpendicular to the longitudinal direction of the batten, deviate from the circumferential direction by an angle of inclination comprised between about +5° and about −5° optionally following spiral paths.

In a second alternative embodiment, not shown, the reinforcing thread-like elements 34*b*, rather than extending along a longitudinal direction substantially parallel to axis X-X of batten 10, extend along respective paths having an angle of inclination comprised between about +20° and about −20 relative to the above longitudinal direction.

The fluid impervious wrapping 31 is preferably made with a substantially fluid impervious elastomeric material, for example butyl-based.

The reinforcing thread-like elements 34*a*, 34*b* are preferably incorporated in an elastomeric material based on diene elastomers charged with at least one reinforcing charge, for example carbon black. Moreover, such elastomeric material usually includes adhesive elements, adapted for promoting the adhesion between the elastomeric material and the reinforcing thread-like elements, for example resorcinol and HMMM (examethoxymethylammine). Said reinforcing thread-like elements preferably comprise cords made of kevlar or of any other high modulus material. The fluid impervious wrapping 31 and layers 33*a* and 33*b* are vulcanized.

As already mentioned, in alternative embodiments (not shown) of batten 10 of the present invention, the reinforcing structure 33 of batten 10 consists of a single layer comprising the reinforcing thread-like elements 34*a* arranged along a substantially circumferential direction, or a direction that could deviate from to the circumferential direction by an angle of inclination comprised between about +5° and about −5°, optionally following spiral paths and the reinforcing thread-like elements 34*b* arranged along the longitudinal direction of batten 10 (axis X-X) or along respective paths having an angle of inclination, relative to the longitudinal direction, comprised between about +20° and about −20°.

At a first end 10*a* thereof, batten 10 of the invention comprises a closing cap 40*a* (FIG. 2). Cap 40*a* comprises a tubular sleeve 41*a* sealingly coupled to an inner surface of the fluid impervious wrapping 31 and a tubular collar 42*a* sealingly coupled to an outer surface of the reinforcing structure 33. In turn, sleeve 41*a* comprises a sealing lip 43*a* in abutment against a front surface of the fluid impervious wrapping 31 and a front end surface 44*a*. Collar 42*a*, on the other hand, comprises a sealing lip 45*a* in abutment against the sealing lip 43*a* and housed in a seat 46*a* formed in the sleeve 41*a* between the sealing lip 43*a* and the front end surface 44*a*.

At the second end lob opposed to the first end 10*a*, batten 10 of the invention comprises a closing cap 40*b* almost similar to cap 40*a*. Cap 40*b* therefore comprises a tubular sleeve 41*b* sealingly coupled to an inner surface of the fluid impervious wrapping 31 and a tubular collar 42*b* sealingly coupled to an outer surface of the reinforcing structure 33. In turn, sleeve 41*b* comprises a sealing lip 43*b* in abutment against a front surface of the fluid impervious wrapping 31 and a front end surface 44*b*. Collar 42*b* comprises a sealing lip 45*b* in abutment against the sealing lip 43*b* and housed in a seat 46*b* formed in the sleeve 41*a* between the sealing lip 43*b* and the front end surface 44*b*.

The tubular collars 42*a*, 42*b*, are pressed until they become deformed onto the respective tubular sleeves 41*a* and 41*b*, so as to constrain the fluid impervious wrapping 31 and the reinforcing structure 33 comprising the above reinforcing thread-like elements 34*a*, 34*b*.

The closing cap 40*b* further comprises an inflating/deflating valve 47 associated, preferably screw-wise, with a seat 48 formed on the end surface 44*b* of sleeve 41*b*. In order to protect such valve 47, sleeve 41*b* comprises a protection lip 49 projecting from the end surface 44*b*. Such protection lip 49 has a cylindrical side surface 490 which is tapered so as to impart to lip 49 the shape of a flute beak. Such cylindrical surface 490 is open at the top thereof so as to allow access to valve 47.

In the example shown, batten 10 has a tubular shape with circular section substantially constant along the entire longitudinal extension thereof. There are provided variations wherein the shape of batten 10 is cylindrical with at least one end tapered as a cone.

Battens 10 are advantageously used in the sails of racing sailing boats (see, for example, sail 1 illustrated in FIGS. 1 and 4*a*-4*d*) to impart the desired bending stiffness to the latter and prevent the flapping of the after leech during the race. Such battens 10 follow the sail profile imposed by the wind, offering to the wind a sail surface as largest as possible. In particular, battens 10, when used in the top portion of the genoa, allow increasing the sail surface exposed to the wind up to 20% without impairing the execution of veer or jibe maneuvers.

According to the present invention, batten 10 allows optimum control of the deformation of the surface of sail 1 during the above direction change maneuvers.

In fact, batten 10 exhibits the advantageous feature of having a predetermined value of bending stiffness based on the working pressure at which it is inflated, such value considerably decreasing, for an increase of the bending load on batten 10 beyond a predetermined value, up to become substantially null when the bending load exceeds a predetermined threshold value. The threshold value of the bending load is function of the inflating pressure of batten 10, of the diameter thereof and of the elasticity modulus of the materials forming the batten.

As already indicated, the decrease of the bending stiffness of batten 10 as the bending load increases is such as to reach a value comprised between 0.01% and 50% of the above predetermined value.

The Applicant has noted that for decreases of the bending stiffness of the batten as the load changes that are close to the lower limit of the above range, that is, close to 0.01% of the above predetermined value, the sailing boat is particularly suitable for races where there are frequent changes of direction, such as in America's Cup match races.

The Applicant has further noted that for decreases of the bending stiffness of the batten as the load changes that are close to the upper limit of the above range, that is, close to 50% of the above predetermined-value, the sailing boat is particularly suitable for races where there are no frequent changes of direction, such as in ocean races.

Preferably, the decrease of the bending stiffness of batten 10 as the bending load increases is such as to reach a value comprised between 0.01% and 30% of the above predetermined value. Even more preferably, the decrease of the bending stiffness of batten 10 as the bending load increases is such as to reach a value comprised between 0.01% and 10% of the above predetermined value. Even more preferably, the decrease of the bending stiffness of batten 10 as the bending load increases is such as to reach a value comprised between 0.01% and 5% of the above predetermined value.

As already mentioned, the predetermined value of bending stiffness with no bending load is preferably comprised between about 10 $Nm^2$ and about 100 $Nm^2$.

As already mentioned, the working pressure of battens 10 is preferably comprised between about 5 bar and about 50 bar. Preferably, the above working pressure is comprised between about 15 bar and about 50 bar for battens with a diameter comprised between about 20 mm and about 35 mm, and between about 5 bar and about 30 bar for battens with a diameter comprised between about 35 mm and about 70 mm.

The preferred use of batten 10 of the present invention is in the genoa of racing sailing boats, where the direction change maneuvers are required to be carried out as quickly as possible without impairing the boat speed.

FIGS. 4*a*-4*d* show a sail 1, similar to that of FIG. 1, in a racing sailing boat, indicated with reference numeral 100, in four different steps of a race. As already said, the sail in particular is a genoa. There are also shown a mainsail 20, provided with battens 30 that may be similar to battens 10 of the present invention, and the mast 50 of the sailing boat.

Figure 4A:
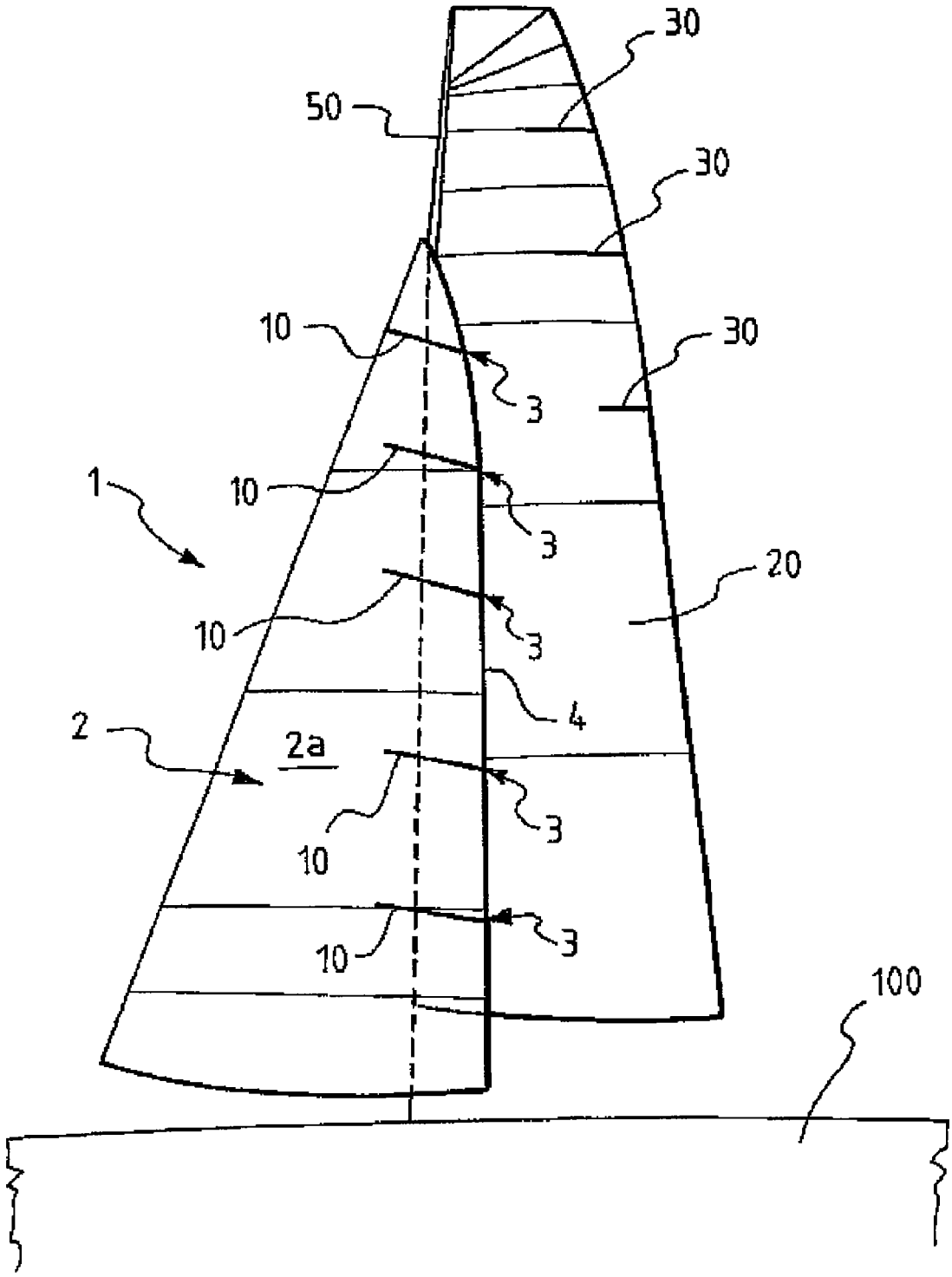
FIG. 4*a* is a view of a sail according to the present invention, used on a sailing boat in a step preceding the execution of a maneuver for changing the direction of the sailing boat.
Figure 4B:
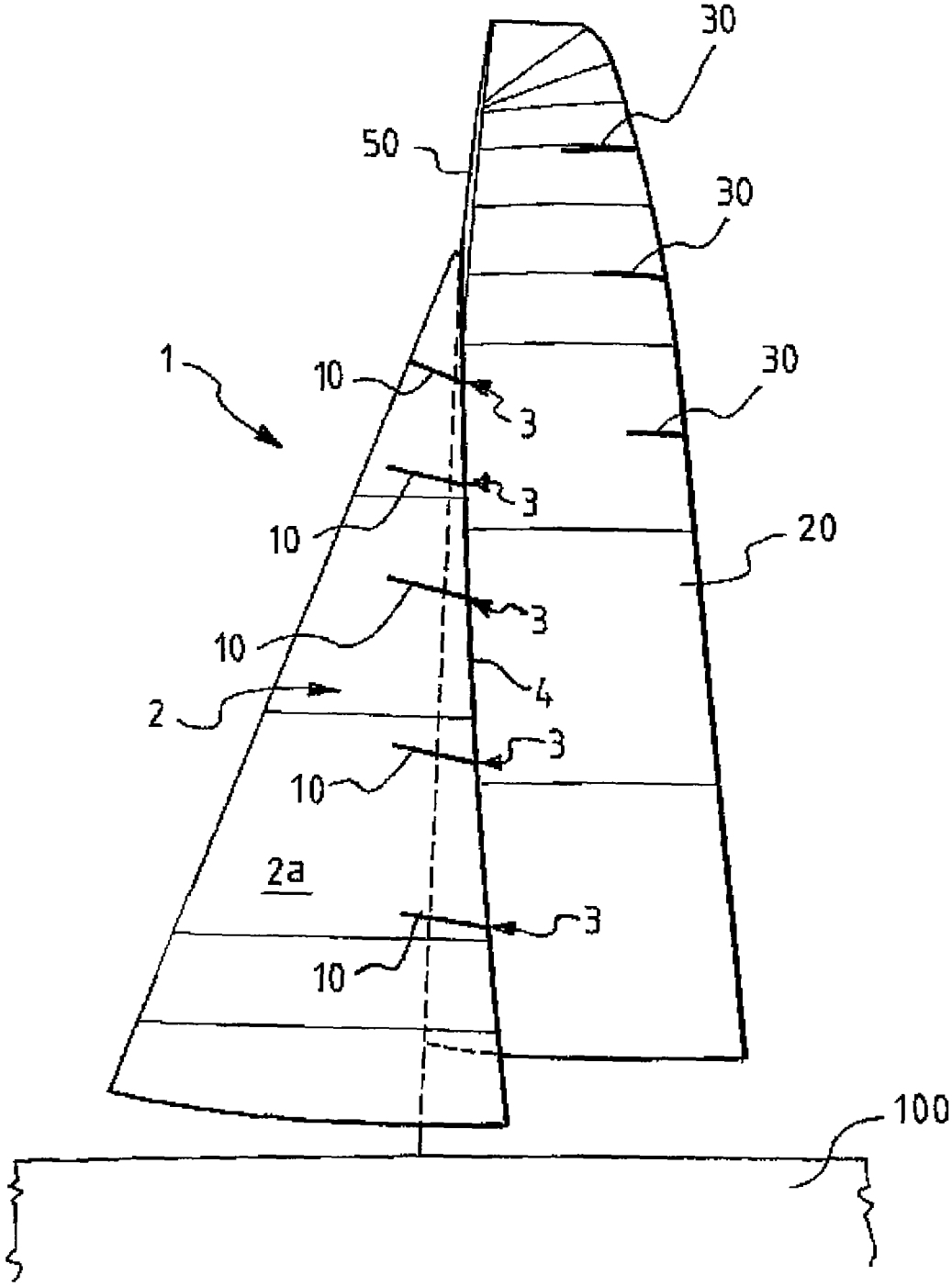
FIGS. 4*b*, 4*c* show the sail of FIG. 4*a* in two consecutive steps of the direction change maneuver.
Figure 4C:
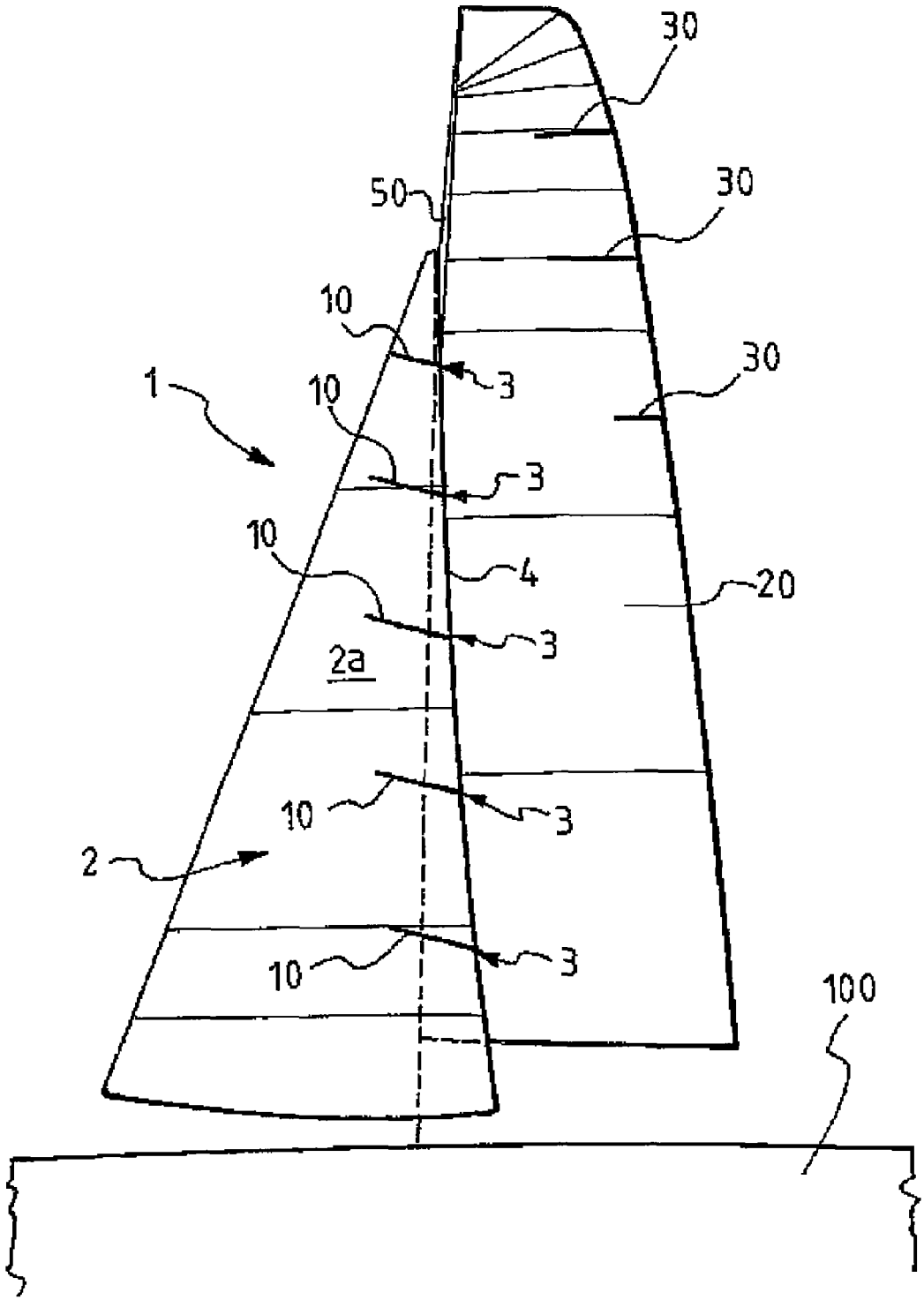
Figure 4D:
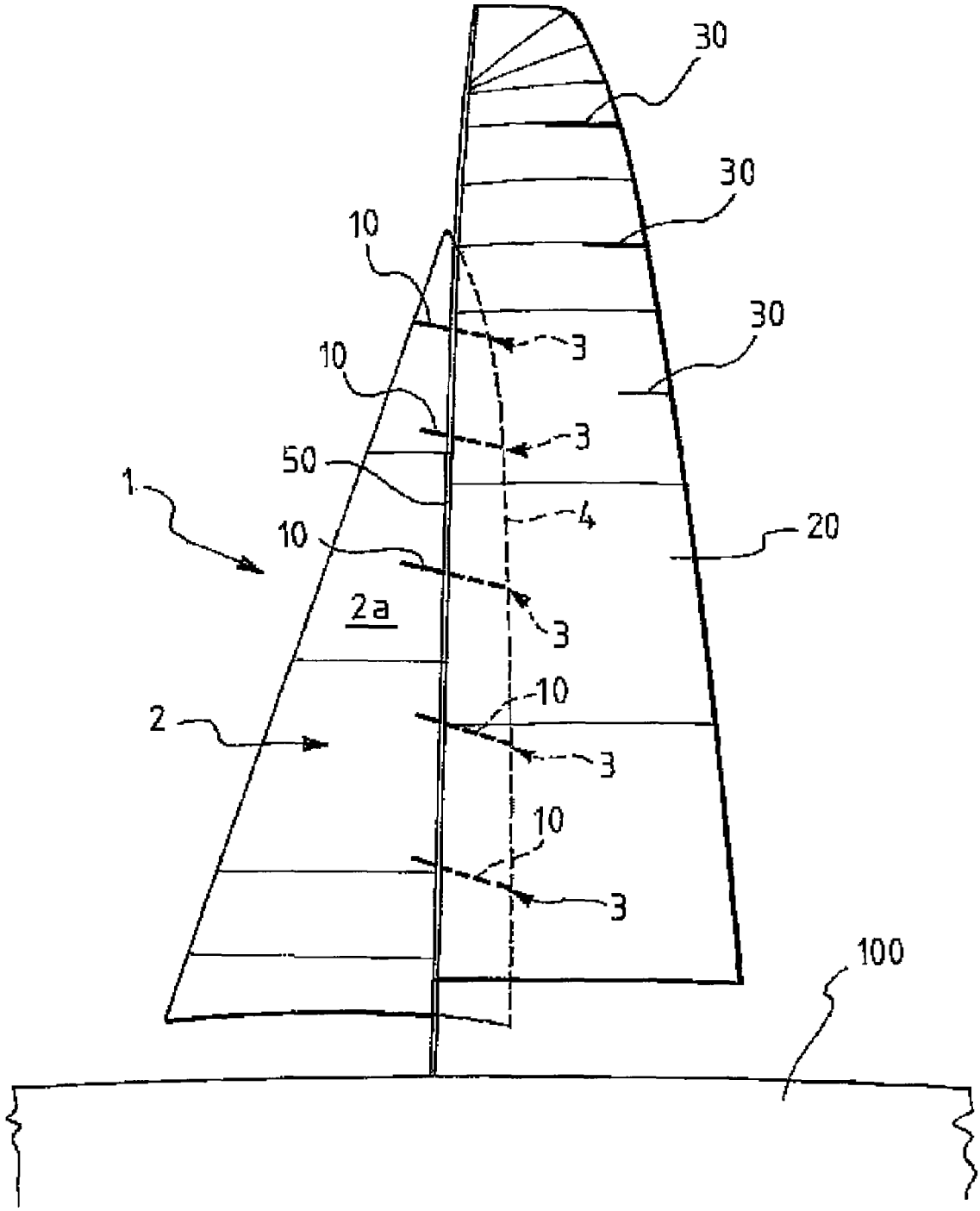
FIG. 4*d* shows the sail of FIG. 4*a* at the end of the direction change maneuver.

In particular, FIG. 4*a* shows the position of the genoa prior to the direction change maneuver, whereas FIG. 4*d* shows the position of the genoa at the end of such maneuver. It can be seen that at the beginning of the maneuver (FIG. 4*a*), the genoa is entirely arranged on one side of boat 100 relative to mast 50, while at the end of the maneuver (FIG. 4*d*), the genoa has entirely passed to the opposite side of boat 100 relative to the mast. FIGS. 4*b* and 4*c* show the genoa while it moves from one side to the other of mast 50 (in particular, note the top portion of the after leech).

During execution of the direction change maneuver, battens 10 hit against the equipment of mast 50 and bend to allow the genoa to pass to the opposite side of the mast.

In particular, as the bending load increases by the effect of the thrust against the equipment of mast 50 and after exceeding a certain critical value of the bending stress (such value depending on the batten diameter, on the inflating pressure and on the elastic modulus of the material forming the batten itself), the bending stiffness of batten 10 considerably decreases, until batten 10 collapses in one or more points, thus almost completely losing its stiffness and passing beyond mast 50 almost without any resistance. Once moved beyond mast 50, batten 10 immediately resumes its initial stiffness and immediately stretches.

Figure 7:
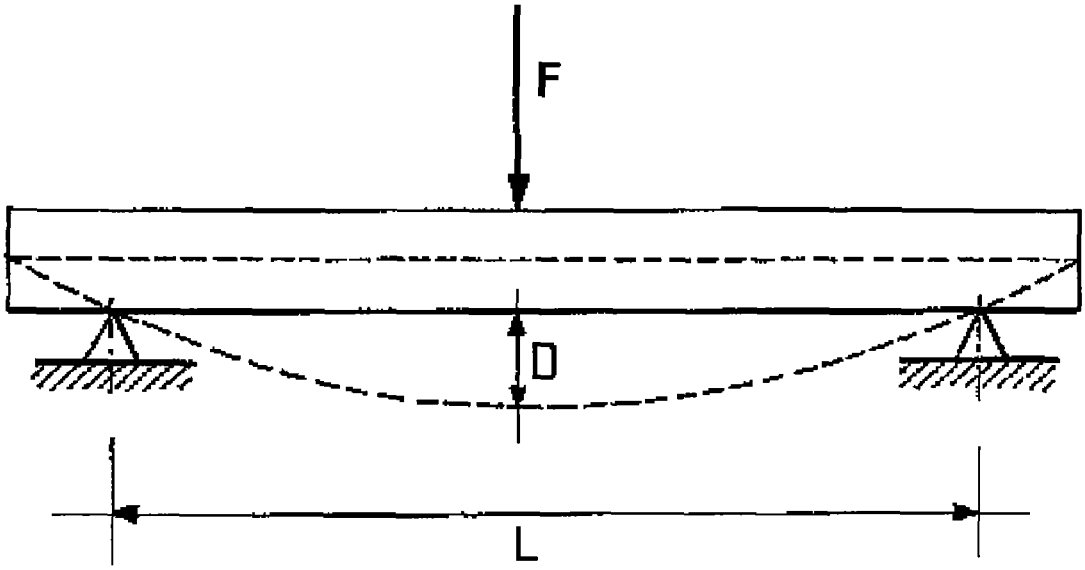
FIG. 7 is a schematic view depicting a test for obtaining the bending stiffness when the load changes as depicted in FIGS. 5 and 6.

The Applicant has carried out a series of experimental tests on battens made in accordance with the present invention. In particular, battens with a thickness equal to 2.5 mm, of various diameters and inflated at different pressure values, were manufactured. Such battens were subjected to an increasing bending load according to the scheme illustrated in FIG. 7 and the deflection stiffness values were recorded (vertical arrow according to the above scheme) by an automatic acquisition system. By applying the formula:

$$EJ=FL^3/48D$$

where:
EJ=bending stiffness;
D=camber or deflection;
F=applied load; and
L=distance between the supports;

the variation of the bending stiffness as a function of the applied load was obtained.

Figure 5:
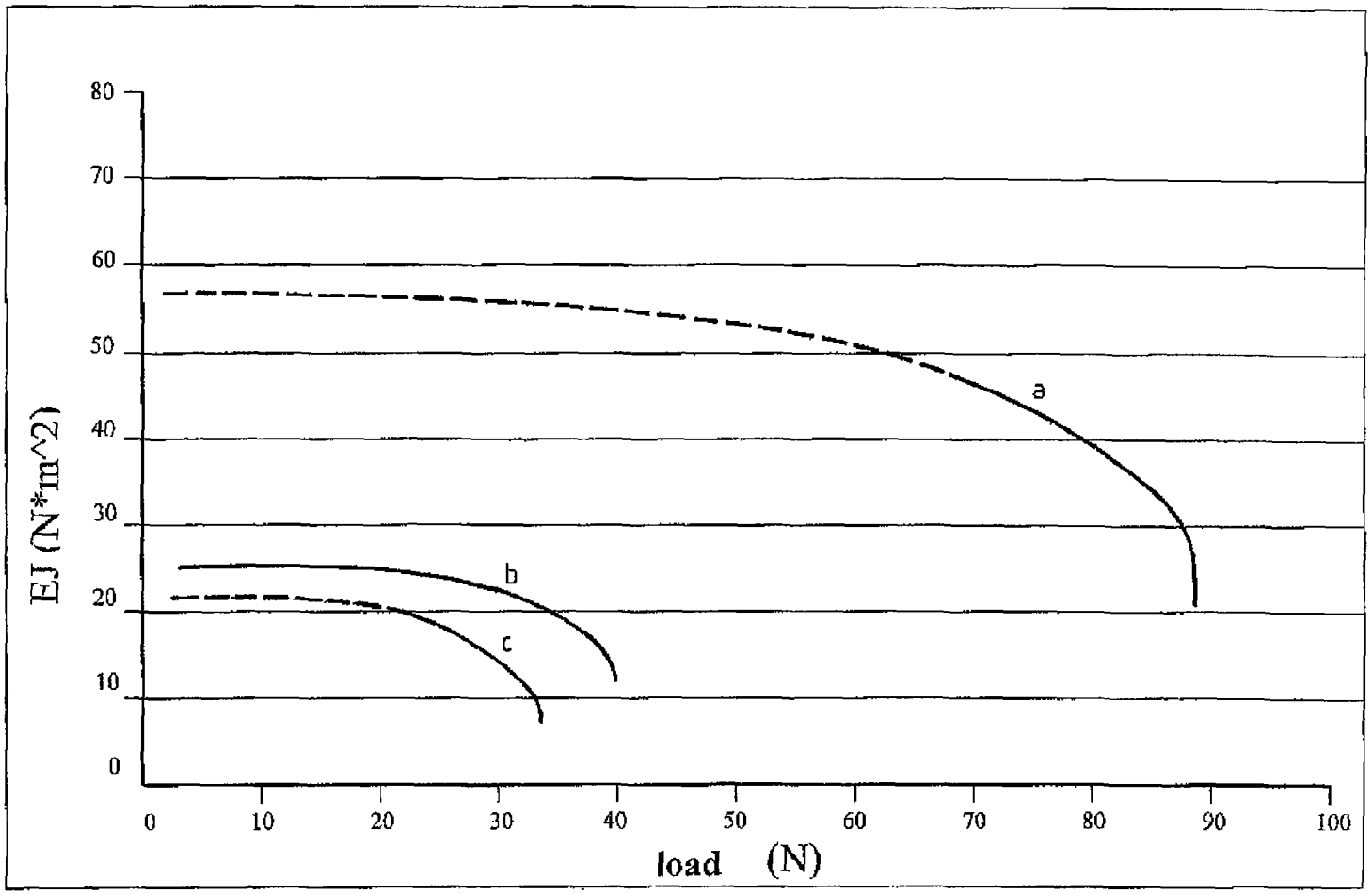
FIG. 5 shows a graph relating to the variation of the bending stiffness based on the bending load obtained by carrying out experimental tests on three battens manufactured according to a preferred embodiment of the present invention.
Figure 6:
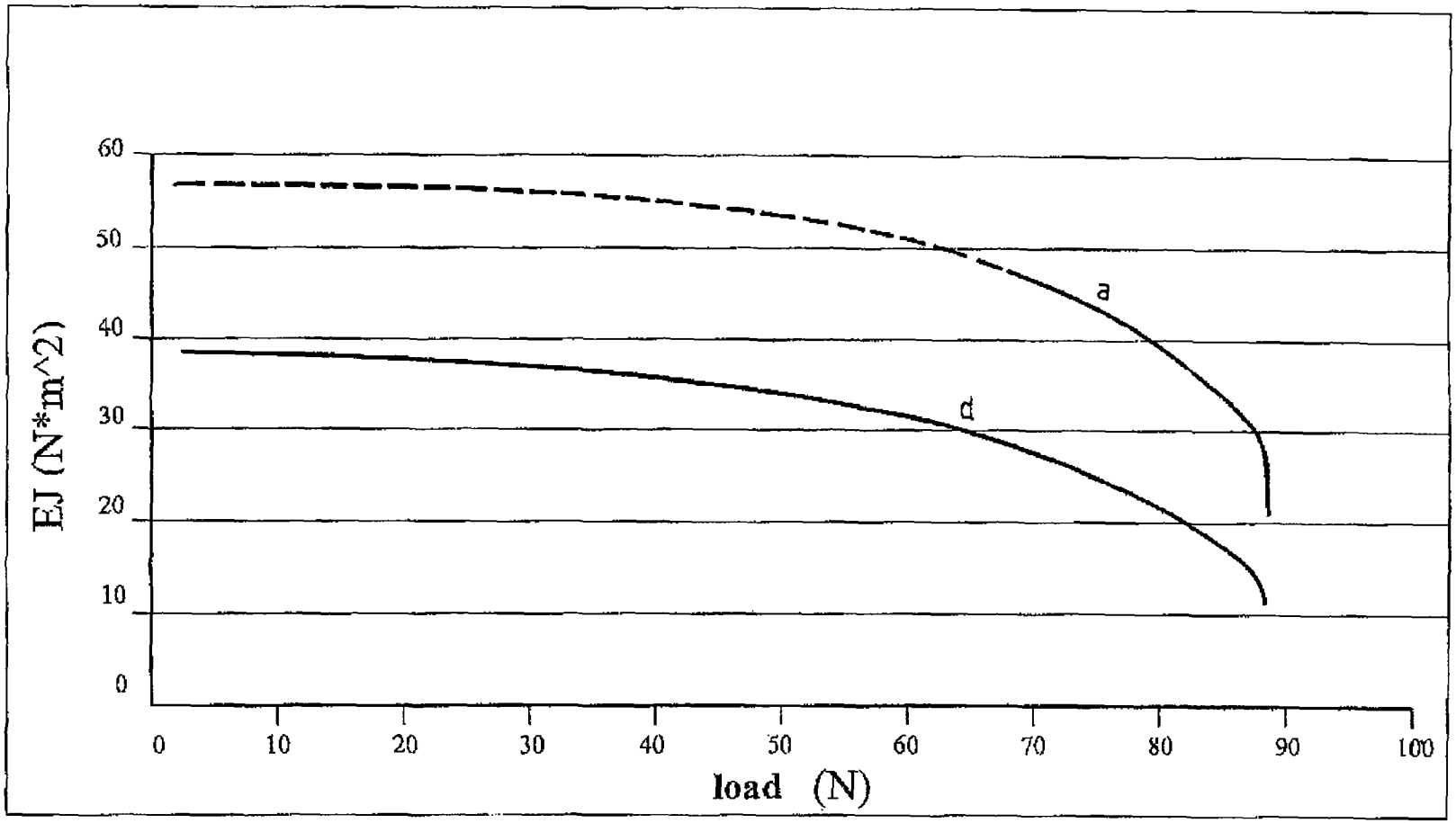
FIG. 6 shows a graph relating to the variation of the bending stiffness based on the bending load obtained comparing a batten manufactured according to a preferred embodiment of the present invention with a batten manufactured according to an alternative embodiment of the present invention.

The result of such experimental tests is shown in the graphs of FIGS. 5 and 6. In such graphs, the values of the bending load the battens were subjected to are indicated on the abscissa axis, whereas the values of the measured bending stiffness are indicated on the ordinate axis.

In particular, FIG. 5 shows the result of three experimental tests carried out on three battens manufactured according to the preferred embodiment of the present invention. Curve a is representative of a batten having an inner diameter equal to 30 mm, inflated at a pressure of 20 bar and whose reinforcing structure consists of a first layer of reinforcing thread-like elements arranged along a substantially circumferential direction and of a second layer, overlapped to the first layer, of reinforcing thread-like elements arranged along a substantially longitudinal direction, that is, in the above reinforcing structure the cross angle between the reinforcing thread-like elements is substantially a right angle. Curve b is representative of a batten having an inner diameter equal to 22 mm, inflated at a pressure of 25 bar and whose reinforcing structure is identical to that of the batten of curve a. Curve c represents a batten having an inner diameter equal to 17 mm, inflated at a pressure of 25 bar and whose reinforcing structure is identical to that of the batten of curve a.

The three curves of the graph of FIG. 5 show how, for each of the battens used in the experimental tests carried out by the Applicant, as the bending load increases the bending stiffness of the batten progressively decreases until, at a threshold value of the bending load, the bending stiffness of the batten falls down to a substantially null value. The lower end of each curve indicates the value of the bending stiffness at which the above downfall of the bending stiffness occurs. The batten collapses at such value. It can be seen that for the batten with a diameter of 30 mm inflated at 20 bar (curve a), the bending stiffness decreases by about 10% for loads up to about 65 N, to then reach the collapse point at about 88 N. In the range of loads up to 65 N, the batten therefore imparts to the sail the stiffness features (bending stiffness values comprised between about 50 $Nm^2$ and about 56 $Nm^2$) adapted for collecting the wind thrust. After the collapse is occurred, the bending stiffness quickly decreases to negligible values. Similarly, for the batten with an inner diameter of 22 mm inflated at 25 bar (curve b), the bending stiffness decreases by about 10%, changing from the value of about 25 $Nm^2$ to the value of about 22 $Nm^2$, for loads up to about 30 N, to then reach the collapse point at about 40 N. After the collapse is occurred, the bending resistance quickly decreases to negligible values. For the batten with an inner diameter of 17 mm inflated at 25 bar (curve c), the bending stiffness decreases by about 10%, changing from the value of about 22 $Nm^2$ to the value of about 20 $Nm^2$, for loads up to about 20 N, to then reach the collapse point at about 33 N.

The curves in the graph of FIG. 5 further show how the bending stiffness of the batten increases as the diameter increases.

Figure 3A:
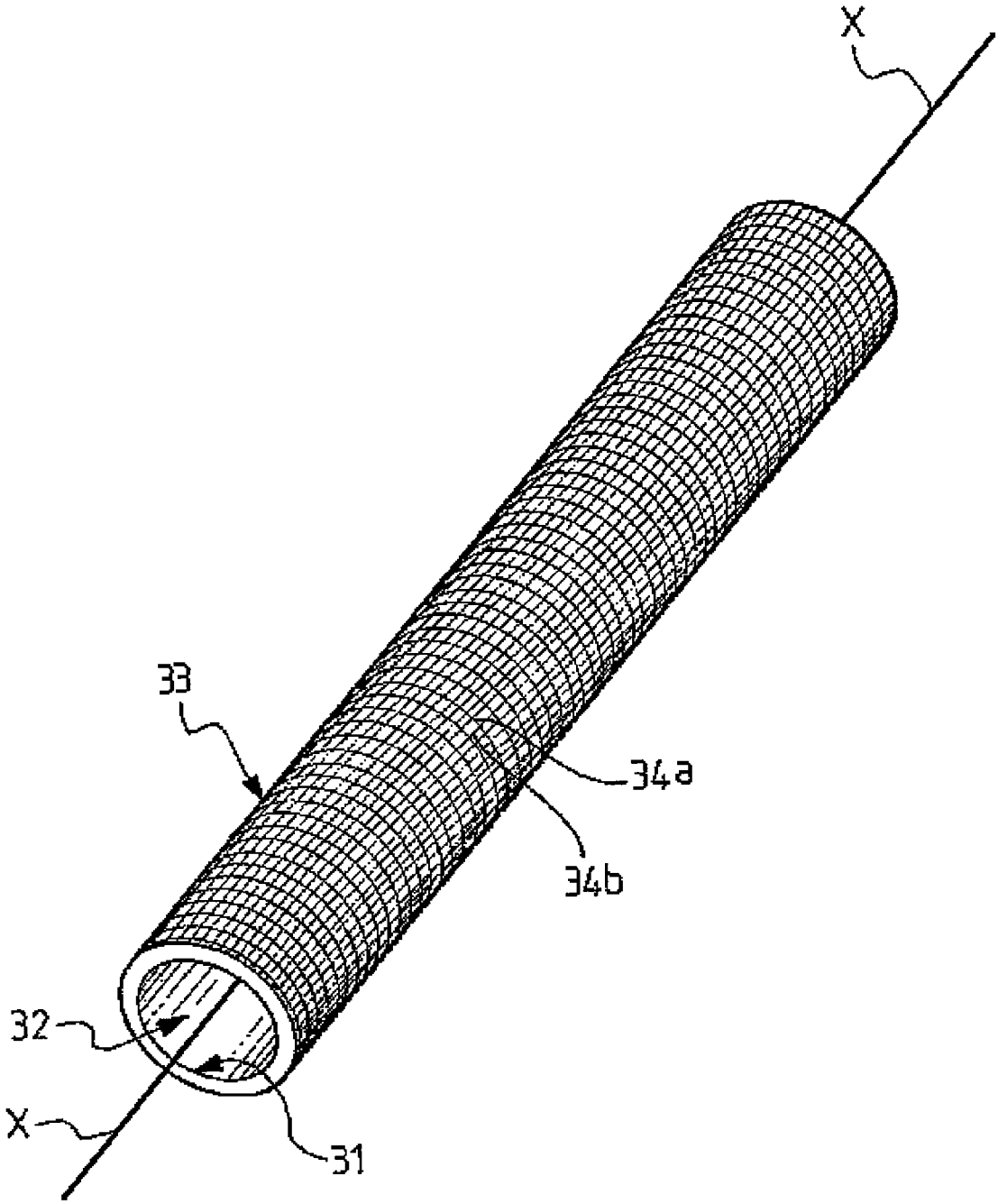
FIG. 3*a* is a schematic perspective view of a central portion of the batten of FIG. 2, according to a further embodiment of the present invention.

FIG. 6, on the other hand, shows a graph relating to the variation of the bending stiffness based on the bending load, wherein there are shown the bending stiffness values based on the load of the batten of curve a and of a batten manufactured according to an optional embodiment of the present invention (curve d). In particular, this is a batten that differs from that of curve a only in that the top layer of reinforcing thread-like elements, rather than comprising reinforcing thread-like elements arranged along a substantially longitudinal direction (as in the case of the batten of curve a), comprises reinforcing thread-like elements arranged along respective paths inclined by an angle of 15° relative to the longitudinal direction (FIG. 3*a*).

It can be seen that for this latter batten (curve d), the bending stiffness decreases by about 20% for loads up to about 65 N, to then reach the collapse point at about 88 N. After the collapse is occurred, the bending stiffness quickly decreases, also in this case, to negligible values. By comparing curve a with curve d it is possible to see that the presence of a layer of substantially circumferential reinforcing thread-like elements and of a layer of substantially longitudinal circumferential reinforcing thread-like elements is advantageous, as compared to the case of a layer of reinforcing thread-like elements inclined by 15° relative to the longitudinal direction, since stronger bending stiffness is obtained up to loads close to the critical load that makes the batten structure unstable.

Finally, by shaping cap 40*b* carrying valve 47 as illustrated in FIG. 2, it is possible to obtain a system adapted for anchoring battens 10 into pockets 3 of sail 1, preferably by a closing tape provided in each pocket 3 that fit into a recess of cap 40*b*.

The invention claimed is:

1. A method for controlling deformation of a surface of a sail of a sailing boat during a direction change maneuver, comprising the steps of:

arranging at least one inflatable batten into a respective seat obtained on a side surface of a sail of a sailing boat, said at least one inflatable batten being inflated at such a pressure as to impart to said at least one inflatable batten a bending stiffness having, with no bending load, a predetermined value;

carrying out a direction change maneuver of the sailing boat, wherein, in a first part of said maneuver, said at least one batten is subjected to an increasing bending load and in a second part of said maneuver said at least one batten is no longer subjected to said bending load, wherein during said maneuver at least one mechanical property of said at least one batten is modified so that as said bending load increases in said first part of the maneuver, a value of the bending stiffness of said at least one batten decreases and as said bending load ends in said second part of the maneuver, the bending stiffness of said at least one batten returns to said predetermined value.

2. The method according to claim 1, wherein the value of said bending stiffness decreases to between about 0.01% and about 50% of said predetermined value.

3. The method according to claim 1, wherein the value of said bending stiffness decreases to between about 0.01% and about 30% of said predetermined value.

4. The method according to claim 1, wherein the value of said bending stiffness decreases to between about 0.01% and about 10% of said predetermined value.

5. The method according to claim 1, wherein the value of said bending stiffness decreases to between about 0.01% and about 5% of said predetermined value.

6. The method according to claim 1, wherein for a bending load higher than a predetermined threshold value, the bending stiffness of said at least one batten is substantially null.

7. The method according to claim 1, wherein said predetermined value of bending stiffness with no bending load is between about 10 $Nm^2$ and about 100 $Nm^2$.

8. The method according to claim 1, wherein said batten is inflated at an operating pressure between about 5 bar and about 50 bar.

9. The method according to claim 8, wherein said working pressure is between about 15 bar and about 50 bar for battens with an inner diameter between about 20 mm and about 35 mm.

10. The method according to claim 8, wherein said working pressure is between about 5 bar and about 30 bar for battens with a diameter between about 35 mm and about 70 mm.

11. The method according to claim 1, wherein said at least one batten comprises a reinforcing structure comprising a plurality of reinforcing thread-like elements arranged crossed to one another.

12. The method according to claim 11, wherein the reinforcing thread-like elements are arranged crossed at a predetermined angle between about 65° and about 115°.

13. The method according to claim 11, wherein the reinforcing thread-like elements are arranged crossed at a predetermined angle between about 70° and about 110°.

14. The method according to claim 11, wherein the reinforcing thread-like elements are arranged crossed at a predetermined angle between about 80° and about 100°.

15. The method according to claim 11, wherein the reinforcing thread-like elements are arranged crossed at a predetermined substantially right angle.

16. The method according to claim 1, wherein said at least one batten comprises a fluid impervious wrapping containing a fluid at a working pressure.

17. The method according to claim 16, wherein a reinforcing structure is associated with said fluid impervious wrapping.

18. The method according to claim 17, wherein said reinforcing structure is external to said fluid impervious wrapping.

19. The method according to claim 11, wherein said reinforcing structure is closed at the ends of said batten.

* * * * *